US009709939B2

(12) United States Patent
Matsumoto et al.

(10) Patent No.: US 9,709,939 B2
(45) Date of Patent: Jul. 18, 2017

(54) IMAGE FORMING SYSTEM WITH AN UNJAMMING EXECUTION SECTION

(71) Applicant: Konica Minolta, Inc., Chiyoda-ku, Tokyo (JP)

(72) Inventors: Hiroshi Matsumoto, Tokyo (JP); Akira Sugishima, Tokyo (JP); Naohiko Hanyu, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/695,189

(22) Filed: Apr. 24, 2015

(65) Prior Publication Data

US 2015/0309465 A1 Oct. 29, 2015

(30) Foreign Application Priority Data

Apr. 28, 2014 (JP) ..... 2014-092820

(51) Int. Cl.

*G03G 15/00* (2006.01)
*B41J 11/70* (2006.01)
*B41J 11/00* (2006.01)

(52) U.S. Cl.

CPC ..... *G03G 15/5012* (2013.01); *B41J 11/006* (2013.01); *G03G 15/652* (2013.01); *G03G 15/6523* (2013.01); *G03G 15/70* (2013.01); *G03G 2215/00455* (2013.01); *G03G 2215/00552* (2013.01)

(58) Field of Classification Search

CPC ..... G03G 15/5012; G03G 15/237; G03G 15/652; G03G 15/6523; G03G 2215/00552; G03G 2215/00455; B41J 11/006

See application file for complete search history.

(56) References Cited

U.S. PATENT DOCUMENTS

2008/0112746 A1* 5/2008 Yamamoto ..... G03G 15/70 399/385
2010/0194026 A1* 8/2010 Iguchi ..... B65H 7/12 271/3.15
2011/0194861 A1 8/2011 Shiraishi (Continued)

FOREIGN PATENT DOCUMENTS

JP 04-235574 A 8/1992
JP 08-091658 A 4/1996

(Continued)

OTHER PUBLICATIONS

Notice of Reasons for Rejection dated Jul. 26, 2016 issued in the corresponding Japanese Patent Application No. 2014-092820 and English translation (7 pages).

(Continued)

*Primary Examiner* — Daniel J Colilla

(74) *Attorney, Agent, or Firm* — Buchanan Ingersoll & Rooney PC

(57) ABSTRACT

The image forming system includes an unjamming execution section configured to execute unjamming for eliminating a sheet jam when the sheet jam is caused in the image forming system; and a control section configured to control the unjamming execution section to execute the unjamming in accordance with a position of the sheet jam or a portion of the long sheet causing the sheet jam, or both in the image forming system.

16 Claims, 9 Drawing Sheets

(56) References Cited

U.S. PATENT DOCUMENTS

| | | | | |
|---|---|---|---|---|
| 2014/0064747 | A1* | 3/2014 | Numazu | G03G 15/5062 399/19 |
| 2014/0294476 | A1* | 10/2014 | Hashimoto | G03G 15/234 399/361 |

FOREIGN PATENT DOCUMENTS

| | | | |
|---|---|---|---|
| JP | 2001-019231 | A | 1/2001 |
| JP | 2008-119935 | A | 5/2008 |
| JP | 2008-254868 | A | 10/2008 |
| JP | 2011-164396 | A | 8/2011 |
| JP | 2011-177948 | A | 9/2011 |

OTHER PUBLICATIONS

Office Action (Notice of Reasons for Rejection) issued on Jan. 10, 2017, by the Japanese Patent Office in corresponding Japanese Patent Application No. 2014-092820, and an English Translation of the Office Action. (7 pages).

* cited by examiner

IMAGE FORMING SYSTEM WITH AN UNJAMMING EXECUTION SECTION

CROSS REFERENCE TO RELATED APPLICATIONS

This application is entitled to and claims the benefit of Japanese Patent Application No. 2014-092820, filed on Apr. 28, 2014, the disclosure of which including the specification, drawings and abstract is incorporated herein by reference in its entirety.

BACKGROUND OF THE INVENTION

1. Field of the Invention

The present invention relates to an image forming system.

2. Description of Related Art

In general, an electrophotographic image forming apparatus (such as a printer, a copy machine, and a fax machine) is configured to irradiate (expose) a charged photoconductor with (to) laser light based on image data to form an electrostatic latent image on the surface of the photoconductor. The electrostatic latent image is then visualized by supplying toner from a developing device to the photoconductor (image carrier) on which the electrostatic latent image is formed, whereby a toner image is formed. Further, the toner image is directly or indirectly transferred to a sheet, followed by heating and pressurization, whereby an image is formed on the sheet.

Conventionally, an image forming system has been known in which a sheet feeding apparatus that feeds a sheet to the above-mentioned image forming apparatus and a sheet ejection apparatus that ejects a sheet conveyed from the image forming apparatus are connected with the image forming apparatus at a preceding side and a succeeding side of the image forming apparatus, respectively.

Japanese Patent Application Laid-Open No. 8-91658 discloses a roll sheet feeding apparatus in which, when a paper jam is caused, roll-paper debris can be easily removed regardless of the leading end portion of the sheet. In accordance with the leading end portion of the sheet at the time when a paper jam is caused, the roll sheet feeding apparatus disclosed in Japanese Patent Application Laid-Open No. 8-91658 winds back the recording sheet to the upstream side when it is desirable to remove the recording sheet on the upstream side rather than the downstream side, whereas the roll sheet feeding apparatus cuts off the recording sheet when it is desirable to remove the recording sheet on the downstream side rather than the upstream side.

In the above-mentioned image forming system, a long sheet may cause a sheet jam in a sheet conveyance path of the long sheets when it is conveyed during an image formation operation for forming an image on the long sheet. In such a case, for recovery, the image formation operation is temporarily stopped, and then whether the long sheet in a stopped state causing the sheet jam has been removed by the user is determined before the image formation operation is restarted. However, removal of the long sheet which has been stopped during the conveyance is a very complicated task since the long sheet may possibly exist across two or more of the sheet feeding apparatus, the image forming apparatus and the sheet ejection apparatus. As such, a large burden has been disadvantageously imposed on the user to restart the image formation operation when a sheet jam is caused during an image formation operation on a long sheet.

It is to be noted that the technology disclosed in Japanese Patent Application Laid-Open No. 8-91658 is not designed for restarting an image formation operation without imposing a large burden on the user when a sheet jam is caused during the image formation operation on a long sheet, and therefore the technology disclosed in Japanese Patent Application Laid-Open No. 8-91658 does not include a configuration for such a purpose.

SUMMARY OF THE INVENTION

An object of the present invention is to provide an image forming system which can restart an image formation operation without imposing a large burden on the user when a sheet jam is caused during an image formation operation on a long sheet.

To achieve the abovementioned object, an image forming system reflecting one aspect of the present invention includes a sheet feeding apparatus configured to feed a long sheet; an image forming apparatus configured to form an image on the long sheet fed by the sheet feeding apparatus; a sheet ejection apparatus configured to eject the long sheet on which an image is formed by the image forming apparatus; an unjamming execution section configured to execute unjamming for eliminating a sheet jam when the sheet jam is caused in the image forming system; and a control section configured to control the unjamming execution section to execute the unjamming in accordance with a position of the sheet jam or a portion of the long sheet causing the sheet jam, or both in the image forming system.

Desirably, the image forming system further includes an operation reception section configured to receive a request to execute the unjamming, wherein the control section executes the unjamming when a request to execute the unjamming is received at the operation reception section.

Desirably, in the image forming system, when the sheet jam is caused in the sheet feeding apparatus at a leading end portion of the long sheet, the unjamming includes a process in which the long sheet is conveyed in a direction opposite to a conveyance direction.

Desirably, in the image forming system, when the sheet jam is caused in the image forming apparatus at a leading end portion of the long sheet on an upstream side in a conveyance direction of an image formation position for forming an image on the long sheet, the unjamming includes a process in which the long sheet is conveyed in a direction opposite to the conveyance direction.

Desirably, the image forming system further includes a first evacuation section configured to evacuate the long sheet from a sheet conveyance path, wherein the unjamming execution section includes a first cutting section provided at a connecting part between the sheet feeding apparatus and the image forming apparatus and configured to cut the long sheet along a width direction, and, when the sheet jam is caused in the image forming apparatus at a leading end portion of the long sheet on an upstream side in a conveyance direction of an image formation position for forming an image on the long sheet, the unjamming includes a process in which a part of the long sheet that is cut by the first cutting section and that remains in the sheet feeding apparatus is conveyed in a direction opposite to the conveyance direction whereas another part of the long sheet that is cut by the first cutting section and that remains in the image forming apparatus is conveyed in the direction opposite to the conveyance direction to the first evacuation section.

Desirably, the image forming system further includes a second evacuation section configured to evacuate the long sheet from a sheet conveyance path, wherein the unjamming execution section includes a first cutting section provided between the sheet feeding apparatus and the image forming apparatus and configured to cut the long sheet along a width direction, the image forming apparatus fixes the image formed on the long sheet to the long sheet, and, when the sheet jam is caused in the image forming apparatus at a leading end portion of the long sheet on a downstream side in a conveyance direction of a fixing position for fixing the image on the long sheet, the unjamming includes a process in which a part of the long sheet that is cut by the first cutting section and that remains in the sheet feeding apparatus is conveyed in a direction opposite to the conveyance direction whereas another part of the long sheet which is cut by the first cutting section and remains in the image forming apparatus is conveyed in the conveyance direction to the second evacuation section.

Desirably, in the image forming system, a speed for conveying the part remaining in the image forming apparatus is a speed at which a fixation process is allowed to be performed and which is lower than a conveyance speed used for a case where the sheet jam is not caused.

Desirably, in the image forming system, when the sheet jam is caused in the sheet ejection apparatus at a leading end portion of the long sheet, the unjamming includes a process in which a conveyance roller disposed immediately before a position where the sheet jam is caused on an upstream side in the conveyance direction is reversely rotated before the conveyance roller is rotated forward.

Desirably, the image forming system further includes a third evacuation section configured to evacuate the long sheet from a sheet conveyance path, wherein the unjamming execution section includes a second cutting section disposed between the image forming apparatus and the sheet ejection apparatus and configured to cut the long sheet along a width direction, and, when the sheet jam is caused in the sheet ejection apparatus at a leading end portion of the long sheet, the unjamming includes a process in which a part of the long sheet that is cut by the second cutting section and that remains in the sheet ejection apparatus is conveyed in a direction opposite to a conveyance direction to the third evacuation section.

Desirably, in the image forming system, when the sheet jam is caused at a middle portion of the long sheet, the unjamming includes a process in which a conveyance roller disposed immediately before a position where the sheet jam is caused on an upstream side in the conveyance direction is reversely rotated before the conveyance roller is rotated forward.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

In the following, the present embodiment is described in detail with reference to the drawings.

[Configuration of Image Forming System 100]

Figure 1:
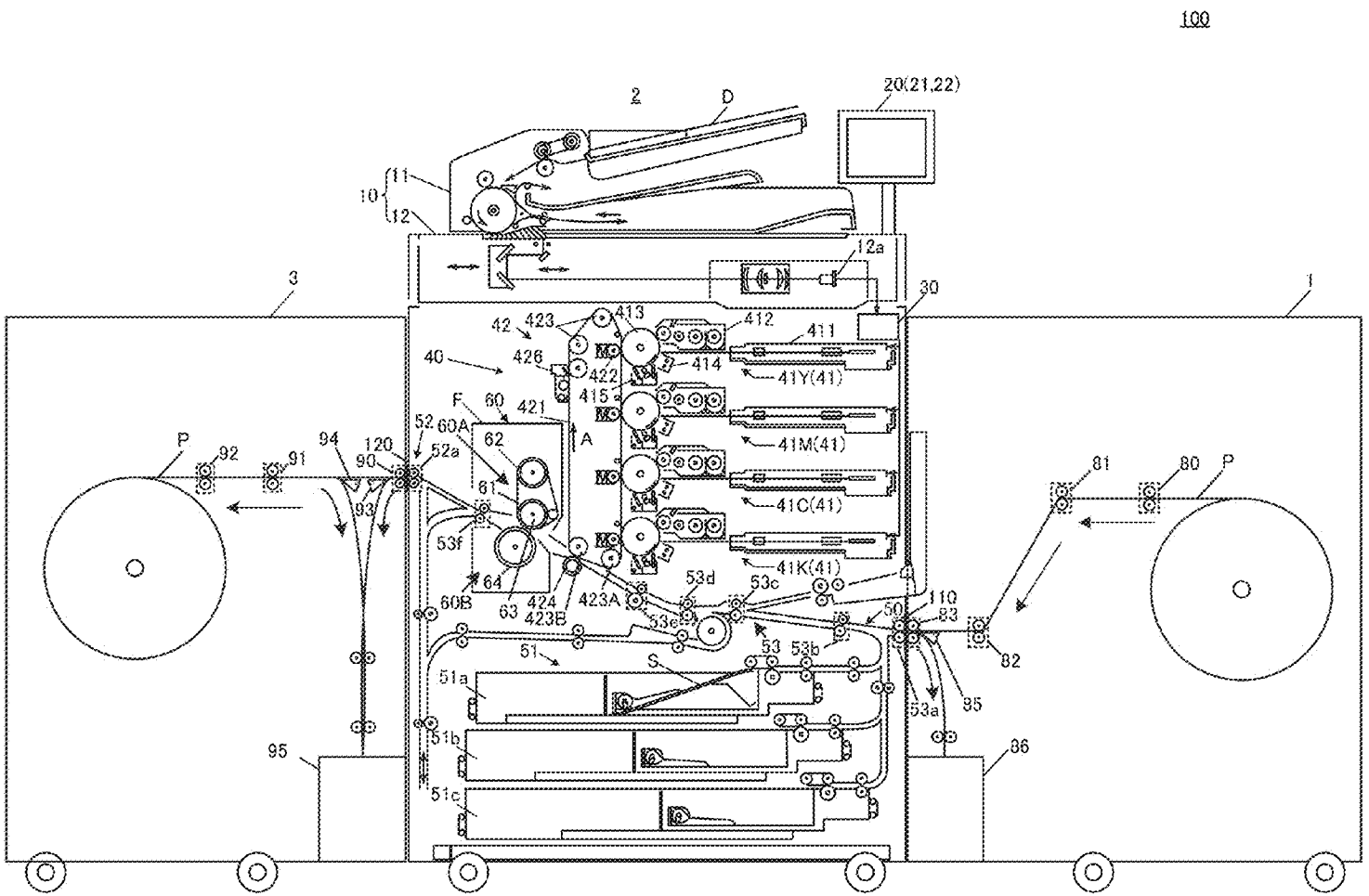
FIG. 1 schematically illustrates a general configuration of an image forming system of a present embodiment.
Figure 2:
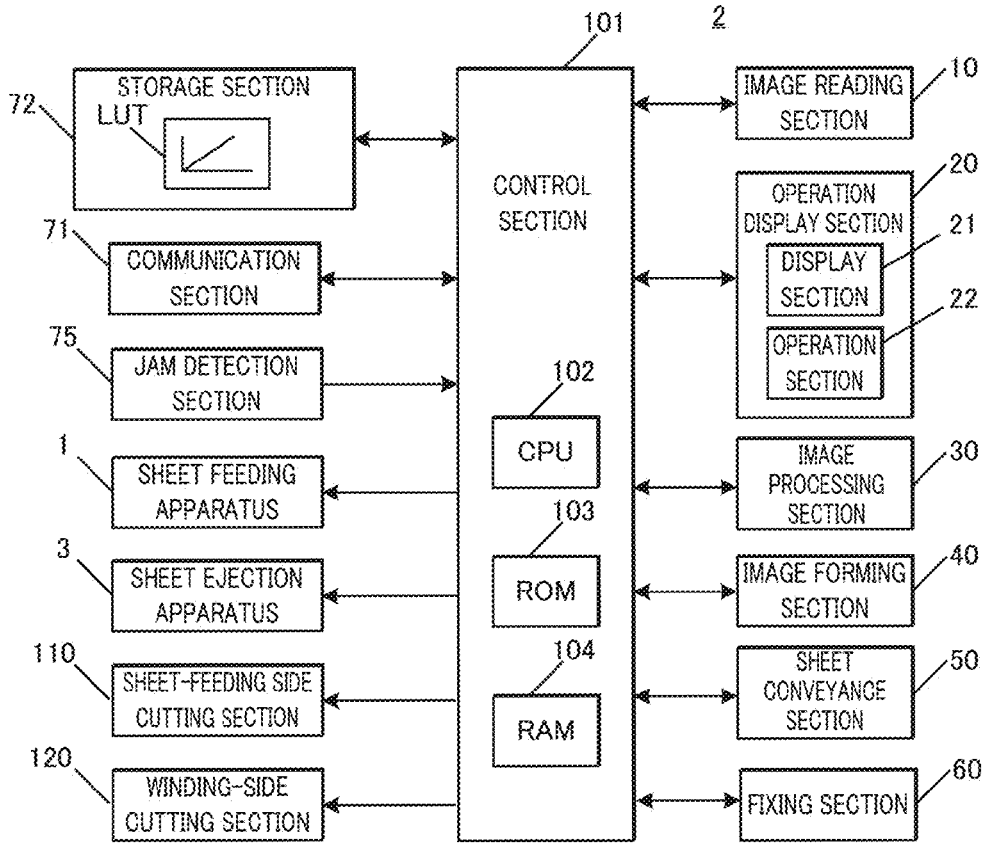
FIG. 2 illustrates a principal part of a control system of an image forming apparatus of the present embodiment.

FIG. 1 schematically illustrates a general configuration of image forming system 100 according to an embodiment of the present invention. FIG. 2 illustrates a principal part of a control system of image forming apparatus 2 according to the present embodiment. Image forming system 100 uses long sheet P or sheet S (non-long sheet) as a recording medium, and forms an image on long sheet P or sheet S. Here, long sheet P is a sheet which has a length greater than a predetermined length (for example, the width of the main body of image forming apparatus 2) in the conveyance direction.

As illustrated in FIG. 1, in image forming system 100, sheet feeding apparatus 1, image forming apparatus 2 and winding apparatus 3 (which corresponds to the "sheet ejection apparatus" of the present invention) are connected to each other from the upstream side in the conveyance direction of long sheet P (hereinafter referred to also as "sheet conveyance direction"). Sheet feeding apparatus 1 and winding apparatus 3 are used when an image is formed on long sheet P.

Sheet feeding apparatus 1 is an apparatus for feeding long sheet P to image forming apparatus 2. As illustrated in FIG. 1, in the housing of sheet feeding apparatus 1, roll-shaped long sheet P is wound around a support shaft and is rotatably held. Sheet feeding apparatus 1 conveys, via a plurality of conveyance roller pairs 80 to 83 (for example, delivery rollers, sheet feed rollers and the like), long sheet P wound around the support shaft out of the apparatus (or to image forming apparatus 2) at a constant speed. The sheet feeding operation of sheet feeding apparatus 1 is controlled by control section 101 of image forming apparatus 2.

Sheet-feeding side cutting section 110 (which corresponds to "first cutting section" of the present invention) that cuts long sheet P along the width direction in a state where long sheet P exists across sheet feeding apparatus 1 and image forming apparatus 2 is provided at a connecting part between sheet feeding apparatus 1 and image forming apparatus 2. To be more specific, sheet-feeding side cutting section 110 includes a cutter blade (not illustrated) that cuts long sheet P, and a moving section (not illustrated) that moves the cutter blade along the width direction orthogonal to the sheet conveyance direction. In a normal state, the cutter blade is pulled out to the outside of the range of the sheet conveyance path (home position) by the moving section. The cutting operation of sheet-feeding side cutting section 110 is controlled by control section 101 of image forming apparatus 2. At the time when long sheet P is cut by sheet-feeding side cutting section 110, control section 101 brings conveyance roller pairs 83 and 53*a*, which are respectively disposed at positions of immediately before the upstream side and the downstream side of sheet-feeding side cutting section 110 in the conveyance direction of long sheet P, into pressure contact with each other to thereby fix long sheet P. It is to be noted that sheet-feeding side cutting section 110 may irradiate long sheet P with laser light to burn and cut off long sheet P by the laser light without using the cutter blade.

In the present embodiment, sheet feeding apparatus 1 is provided with sheet feeding side evacuation section 86 (which corresponds to "first evacuation section" of the embodiment of the present invention) configured to evacuate long sheet P from the sheet conveyance path when long sheet P is cut by sheet-feeding side cutting section 110.

It is to be noted that, in sheet feeding apparatus 1, long sheet P may not be held in a roll shape, and a plurality of long sheets P of a predetermined size (for example, 210 [mm]×1200 [mm]) may be held.

Image forming apparatus 2 is a color-image forming apparatus of an intermediate transfer system using electrophotographic process technology. That is, image forming apparatus 2 transfers (primary-transfers) toner images of yellow (Y), magenta (M), cyan (C), and black (K) formed on photoconductor drums 413 to intermediate transfer belt 421, and superimposes the toner images of the four colors on one another on intermediate transfer belt 421. Then, image forming apparatus 2 transfers (secondary-transfers) the resultant image to long sheet P fed from sheet feeding apparatus 1 or sheet S sent from sheet feed tray units 51*a* to 51*c*, to thereby form an image.

A longitudinal tandem system is adopted for image forming apparatus 2. In the longitudinal tandem system, respective photoconductor drums 413 corresponding to the four colors of YMCK are placed in series in the travelling direction (vertical direction) of intermediate transfer belt 421, and the toner images of the four colors are sequentially transferred to intermediate transfer belt 421 in one cycle.

As illustrated in FIG. 2, image forming apparatus 2 includes image reading section 10, operation display section 20, image processing section 30, image forming section 40, sheet conveyance section 50, fixing section 60, jam detection section 75, and control section 101.

Control section 101 includes central processing unit (CPU) 102, read only memory (ROM) 103, random access memory (RAM) 104 and the like. CPU 102 reads out a program corresponding to processing details from ROM 103, loads the program in RAM 104, and performs a centralized control of operations of the blocks and the like of image forming apparatus 2 in conjunction with the loaded program. At this time, CPU 101 refers to various kinds of data stored in storage section 72. Storage section 72 is composed of, for example, a non-volatile semiconductor memory (so-called flash memory) or a hard disk drive.

Control section 101 transmits and receives various data to and from an external apparatus (for example, a personal computer) connected to a communication network such as a local area network (LAN) or a wide area network (WAN), through communication section 71. Control section 101 receives, for example, image data transmitted from the external apparatus, and performs control to form an image on long sheet P or sheet S on the basis of the image data (input image data). Communication section 71 is composed of, for example, a communication control card such as a LAN card.

Image reading section 10 includes auto document feeder (ADF) 11, document image scanner (scanner) 12, and the like.

Auto document feeder 11 causes a conveyance mechanism to feed document D placed on a document tray, and sends out document D to document image scanner 12. Auto document feeder 11 enables images (even both sides thereof) of a large number of documents D placed on the document tray to be successively read at once.

Document image scanner 12 optically scans a document fed from auto document feeder 11 to its contact glass or a document placed on its contact glass, and images light reflected from the document on the light receiving surface of charge coupled device (CCD) sensor 12*a*, to thereby read the document image. Image reading section 10 generates input image data on the basis of a reading result provided by document image scanner 12. Image processing section 30 performs predetermined image processing on the input image data.

Operation display section 20 includes, for example, a liquid crystal display (LCD) with a touch panel, and functions as display section 21 and operation section 22. Controls display section 21 to displays various operation screens, image conditions, operating statuses of functions, and the like in accordance with display control signals received from control section 101. Operation section 22 (corresponding to "operation reception section") of the embodiment of the present invention) includes various operation keys such as numeric keys and a start key, receives various input operations performed by a user, and outputs operation signals to control section 101. Operation section 22 receives a request to execute unjamming which is described later, and outputs an operation signal corresponding to the received request to execute unjamming to control section 101.

Image processing section 30 includes a circuit that performs a digital image process suited to initial settings or user settings on the input image data, and the like. For example, image processing section 30 performs tone correction on the basis of tone correction data (tone correction table), under the control of control section 101. In addition to the tone correction, image processing section 30 also performs various correction processes such as color correction and shading correction as well as a compression process, on the input image data. Image forming section 40 is controlled on the basis of the image data that has been subjected to these processes.

Image forming section 40 includes: image forming units 41Y, 41M, 41C, and 41K for images of colored toners respectively containing a Y component, an M component, a C component, and a K component on the basis of the input image data; intermediate transfer unit 42; and the like.

Image forming units 41Y, 41M, 41C, and 41K for the Y component, the M component, the C component, and the K component have a similar configuration. For ease of illustration and description, common elements are denoted by the same reference signs. Only when elements need to be discriminated from one another, Y, M, C, or K is added to their reference signs. In FIG. 1, reference signs are given to only the elements of image forming unit 41Y for the Y component, and reference signs are omitted for the elements of other image forming units 41M, 41C, and 41K.

Image forming unit 41 includes exposure device 411, developing device 412, photoconductor drum 413, charging device 414, drum cleaning device 415 and the like.

Photoconductor drums 413 are, for example, negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) which is made of aluminum and has a diameter of 80 [mm]. The charge generation layer is made of an organic semiconductor in which a charge generating material (for example, phthalocyanine pigment)

is dispersed in a resin binder (for example, polycarbonate), and generates a pair of positive charge and negative charge through light exposure by exposure device 411. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Control section 101 controls a driving current supplied to a driving motor (not shown in the drawings) that rotates photoconductor drums 413, whereby photoconductor drums 413 is rotated at a constant circumferential speed.

Charging device 414 evenly negatively charges the surface of photoconductor drum 413. Exposure device 411 is composed of, for example, a semiconductor laser, and configured to irradiate photoconductor drum 413 with laser light corresponding to the image of each color component. Since the positive charge is generated in the charge generation layer of photoconductor drum 413 and is transported to the surface of the charge transport layer, the surface charge (negative charge) of photoconductor drum 413 is neutralized. An electrostatic latent image of each color component is formed on the surface of photoconductor drum 413 by the potential difference from its surroundings.

Developing device 412 is a developing device of a two-component developing type, and attaches toners of respective color components to the surface of photoconductor drums 413, and visualizes the electrostatic latent image to form a toner image.

Drum cleaning device 415 includes a drum cleaning blade that is brought into sliding contact with the surface of photoconductor drum 413, and removes residual toner that remains on the surface of photoconductor drum 413 after the primary transfer.

Intermediate transfer unit 42 includes intermediate transfer belt 421, primary transfer roller 422, a plurality of support rollers 423, secondary transfer roller 424, belt cleaning device 426 and the like.

Intermediate transfer belt 421 is composed of an endless belt, and is stretched around the plurality of support rollers 423 in a loop form. At least one of the plurality of support rollers 423 is composed of a driving roller, and the others are each composed of a driven roller. Preferably, for example, roller 423A disposed on the downstream side in the belt travelling direction relative to primary transfer rollers 422 for K-component is a driving roller. With this configuration, the travelling speed of the belt at a primary transfer section can be easily maintained at a constant speed. When driving roller 423A rotates, intermediate transfer belt 421 travels in arrow A direction at a constant speed.

Intermediate transfer belt 421 is a belt having conductivity and elasticity which includes on the surface thereof a high resistance layer having a volume resistivity of 8 to 11 [log Ω·cm]. Intermediate transfer belt 421 is rotationally driven by a control signal from control section 101. It is to be noted that the material, thickness and hardness of intermediate transfer belt 421 are not limited as long as intermediate transfer belt 421 has conductivity and elasticity.

Primary transfer rollers 422 are disposed to face photoconductor drums 413 of respective color components, on the inner periphery side of intermediate transfer belt 421. Primary transfer rollers 422 are brought into pressure contact with photoconductor drums 413 with intermediate transfer belt 421 therebetween, whereby a primary transfer nip for transferring a toner image from photoconductor drums 413 to intermediate transfer belt 421 is formed.

Secondary transfer roller 424 is disposed to face roller 423B (hereinafter referred to as "backup roller 423B") disposed on the downstream side in the belt travelling direction relative to driving roller 423A, on the outer peripheral surface side of intermediate transfer belt 421. Secondary transfer roller 424 is brought into pressure contact with backup roller 423B with intermediate transfer belt 421 therebetween, whereby a secondary transfer nip (which corresponds to "image formation position" of the embodiment of the present invention) for transferring a toner image from intermediate transfer belt 421 to long sheet P or sheet S is formed.

When intermediate transfer belt 421 passes through the primary transfer nip, the toner images on photoconductor drums 413 are sequentially primary-transferred to intermediate transfer belt 421. To be more specific, a primary transfer bias is applied to primary transfer rollers 422, and an electric charge of the polarity opposite to the polarity of the toner is applied to the rear side (the side that makes contact with primary transfer rollers 422) of intermediate transfer belt 421, whereby the toner image is electrostatically transferred to intermediate transfer belt 421.

Thereafter, when long sheet P or sheet S passes through the secondary transfer nip, the toner image on intermediate transfer belt 421 is secondary-transferred to long sheet P or sheet S. To be more specific, a secondary transfer bias is applied to secondary transfer roller 424, and an electric charge of the polarity opposite to the polarity of the toner is applied to the rear side (the side that makes contact with secondary transfer roller 424) of long sheet P or sheet S, whereby the toner image is electrostatically transferred to long sheet P or sheet S. Long sheet P or sheet S on which the toner images have been transferred is conveyed toward fixing section 60.

Belt cleaning device 426 removes transfer residual toner which remains on the surface of intermediate transfer belt 421 after a secondary transfer. A configuration (so-called belt-type secondary transfer unit) in which a secondary transfer belt is installed in a stretched state in a loop form around a plurality of support rollers including a secondary transfer roller may also be adopted in place of secondary transfer roller 424.

Fixing section 60 includes: upper fixing section 60A having a fixing side member disposed on a fixing surface (the surface on which a toner image is formed) side of long sheet P or sheet S; lower fixing section 60B having a back side supporting member disposed on the rear surface (the surface opposite to the fixing surface) side of long sheet P or sheet S; and the like. The back side supporting member is brought into pressure contact with the fixing side member, whereby a fixing nip (which corresponds to the "fixing position" of the embodiment of the present invention) for conveying sheet S in a tightly sandwiching manner is formed.

Fixing section 60 applies, at the fixing nip, heat and pressure to long sheet P or sheet S on which a toner image has been secondary-transferred, thereby fixing the toner image on long sheet P or sheet S. Fixing section 60 is disposed as a unit in fixing part F. In addition, fixing part F may be provided with an air-separating unit that blows air to separate long sheet P or sheet S from the fixing side member or the back side supporting member.

Upper side fixing section 60A includes endless fixing belt 61, heating roller 62 and fixing roller 63, which serve as a fixing side member (belt heating system). Fixing belt 61 is installed in a stretched state around heating roller 62 and fixing roller 63 with a predetermined belt tensile force (for example, 40 [N]).

Fixing belt 61 makes contact with long sheet P or sheet S on which a toner image is formed, and thermally fixes the toner image on long sheet P or sheet S at a fixation temperature (for example, 160 to 200[° C.]). The fixing temperature is a temperature at which a heat energy required for melting the toner on long sheet P or sheet S can be obtained, and the fixing temperature differs depending on factors such as the type of long sheet P or sheet S on which an image is to be formed.

Heating roller 62 incorporates a heating source (halogen heater) and applies heat to fixing belt 61. The temperature of a heating source is controlled by control section 101. The heating source applies heat to heating roller 62, and as a result, fixing belt 61 is heated.

Fixing roller 63 is driven and controlled (for example, turn on/off of rotation, circumferential velocity, and the like) by control section 101. Control section 101 rotates fixing roller 63 in the clockwise direction. When fixing roller 63 rotates, fixing belt 61 and heating roller 62 rotate in the clockwise direction to follow the rotation of fixing roller 63.

Lower side fixing section 60B includes pressure roller 64 serving as a back side supporting member (roller pressing type). Pressure roller 64 is driven and controlled (for example, on/off of rotation, circumferential velocity, and the like) by control section 101. Control section 101 rotates pressure roller 64 in the counterclockwise direction. Pressure roller 64 is brought into pressure contact with fixing roller 63 with fixing belt 61 therebetween by a predetermined fixing load (for example, 1000 [N]). Thus, a fixing nip for conveying sheet S in a tightly sandwiching manner is formed between fixing belt 61 and pressure roller 64.

Sheet conveyance section 50 includes sheet feeding section 51, sheet ejection section 52, conveyance path section 53 and the like. Three sheet feed tray units 51*a* to 51*c* included in sheet feeding section 51 store sheets S (standard sheets, special sheets) discriminated on the basis of the basis weight, the size, and the like, for each type set in advance. Conveyance path section 53 has a plurality of conveyance roller pairs 53*a* to 53*f* including a pair of registration rollers 53*e*.

The recording sheets S stored in sheet tray units 51*a* to 51*c* are output one by one from the uppermost, and conveyed to image forming section 40 by conveyance path section 53. At this time, the registration roller section in which the pair of registration rollers 53*e* are arranged corrects skew of sheet S fed thereto, and the conveyance timing is adjusted. Then, in image forming section 40, the toner image on intermediate transfer belt 421 is secondary-transferred to one side of sheet S at one time, and a fixing process is performed in fixing section 60. Long sheet P fed from sheet feeding apparatus 1 to image forming apparatus 2 is conveyed to image forming section 40 by conveyance path section 53. Then, in image forming section 40, the toner image on intermediate transfer belt 421 is secondary-transferred to one side of long sheet P at one time, and a fixing process is performed in fixing section 60. Long sheet P or sheet S on which an image has been formed is ejected (to winding apparatus 3) out of the image forming apparatus by sheet ejection section 52 including conveyance roller pair (sheet discharging roller pair) 52*a*.

Winding apparatus 3 is an apparatus for winding up long sheet P conveyed from image forming apparatus 2. As illustrated in FIG. 1, in the housing of winding apparatus 3, long sheet P is wound around a support shaft and held in a roll shape for example. As such, winding apparatus 3 winds up long sheet P which is conveyed from image forming apparatus 2 via a plurality of conveyance roller pairs 90 to 92 (for example, delivery rollers and sheet ejection rollers) around the support shaft at a constant speed. The winding operation of winding apparatus 3 is controlled by control section 101 of image forming apparatus 2.

At a connecting part between image forming apparatus 2 and winding apparatus 3, winding-side cutting section 120 (which corresponds to "second cutting section" of the embodiment of the present invention) that cuts long sheet P along the width direction in a state where long sheet P exists across image forming apparatus 2 and winding apparatus 3 is provided. To be more specific, winding-side cutting section 120 includes a cutter blade (not illustrated) that cuts long sheet P, and a moving section (not illustrated) that moves the cutter blade along the width direction orthogonal to the sheet conveyance direction. In a normal state, the cutter blade is pulled out to the outside of the range of the sheet conveyance path (home position) by the moving section. The cutting operation of winding-side cutting section 120 is controlled by control section 101 of image forming apparatus 2. At the time when long sheet P is cut by winding-side cutting section 120, control section 101 brings conveyance roller pairs 52*a* and 90, which are respectively disposed at positions of immediately before the upstream side and the downstream side of winding-side cutting section 120 in the conveyance direction of long sheet P, into pressure contact with each other to thereby fix long sheet P. It is to be noted that winding-side cutting section 120 may irradiate long sheet P with laser light to burn and cut off long sheet P by the laser light without using the cutter blade.

In the present embodiment, winding apparatus 3 is provided with winding-side evacuation section 95 (which corresponds to "second evacuation section" and "third evacuation section" of the embodiment of the present invention) configured to evacuate long sheet P from the sheet conveyance path when long sheet P is cut by winding-side cutting section 120.

With use of optical sensors disposed at respective positions of the sheet conveyance path of long sheet P, jam detection section 75 detects passage of each part of long sheet P, and detects a sheet jam (paper jam) when the passage time between the positions is greater than a predetermined time. Then, jam detection section 75 outputs a jam code corresponding to a detected sheet jam to control section 101. The jam code is a jam identification number for uniquely specifying conditions (such as, for example, position, factor, date, and time) where a sheet jam is caused. Control section 101 can determine the detailed state of the sheet jam by referring to a jam code output from jam detection section 75. It is to be noted that the jam code may also contain specific information other than the conditions of a jam. In addition, jam detection section 75 may be composed of a mechanism other than the optical sensor, such as a mechanical switch.

When a sheet jam is caused in image forming system 100, control section 101 stops the image formation operation, and controls the execution of unjamming for eliminating the sheet jam in accordance with the condition of the sheet jam. In the present embodiment, control section 101 executes unjamming when a request to execute unjamming is received at operation section 22.

Figure 3:
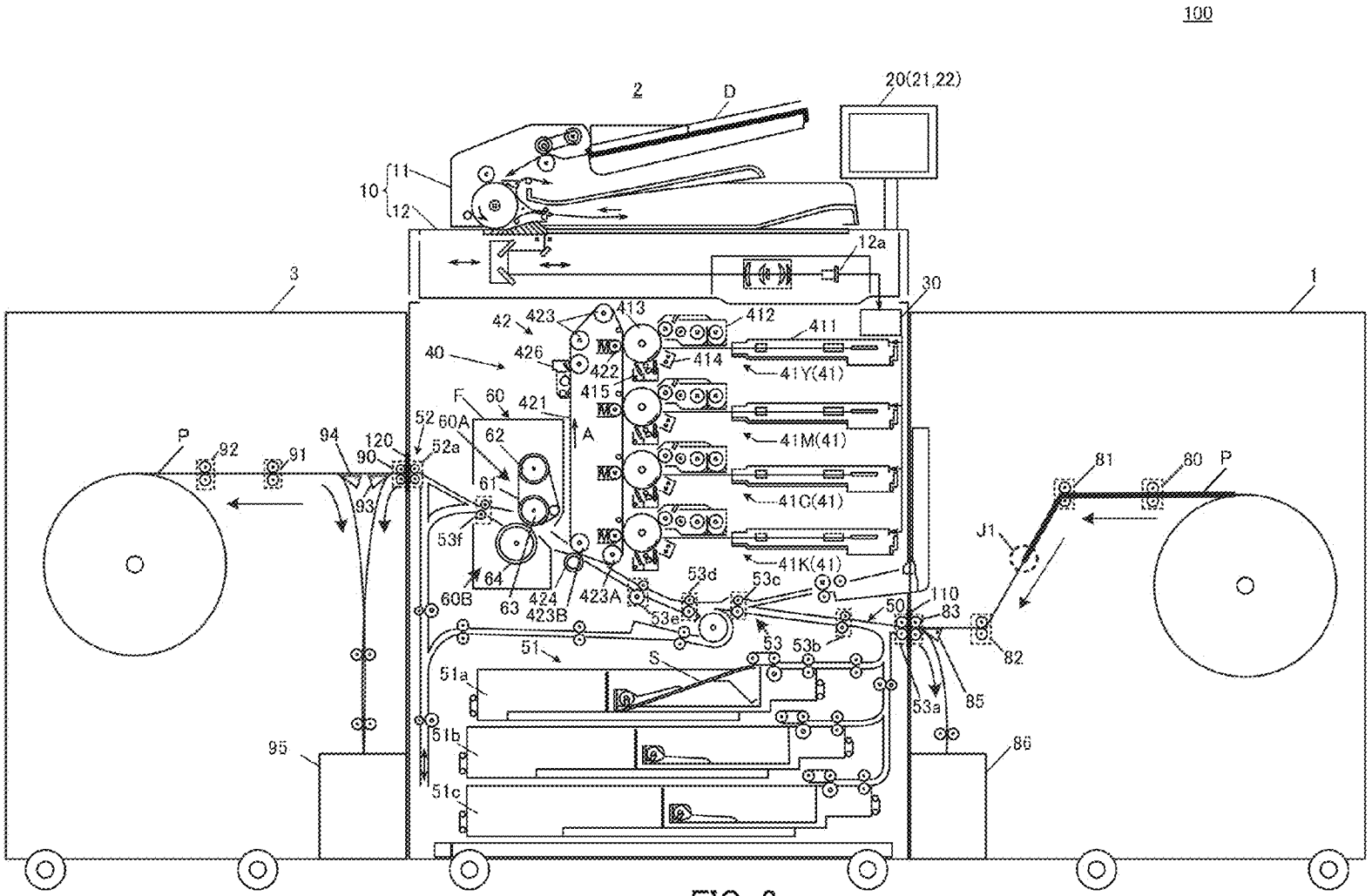
FIG. 3 illustrates a condition of a sheet jam in the present embodiment.

For example, when a sheet jam is caused at a leading end portion of long sheet P in sheet feeding apparatus 1 (at position J1 on the sheet conveyance path in FIG. 3, for example), control section 101 reversely rotates conveyance roller pairs 80 and 81, to thereby convey long sheet P in the direction opposite to the conveyance direction until the leading end portion of long sheet P moves to the upstream side of conveyance roller pair 80 in the conveyance direction. Thereafter, the user opens the front door of sheet feeding apparatus 1 to reset long sheet P in sheet feeding apparatus 1.

Figure 4:
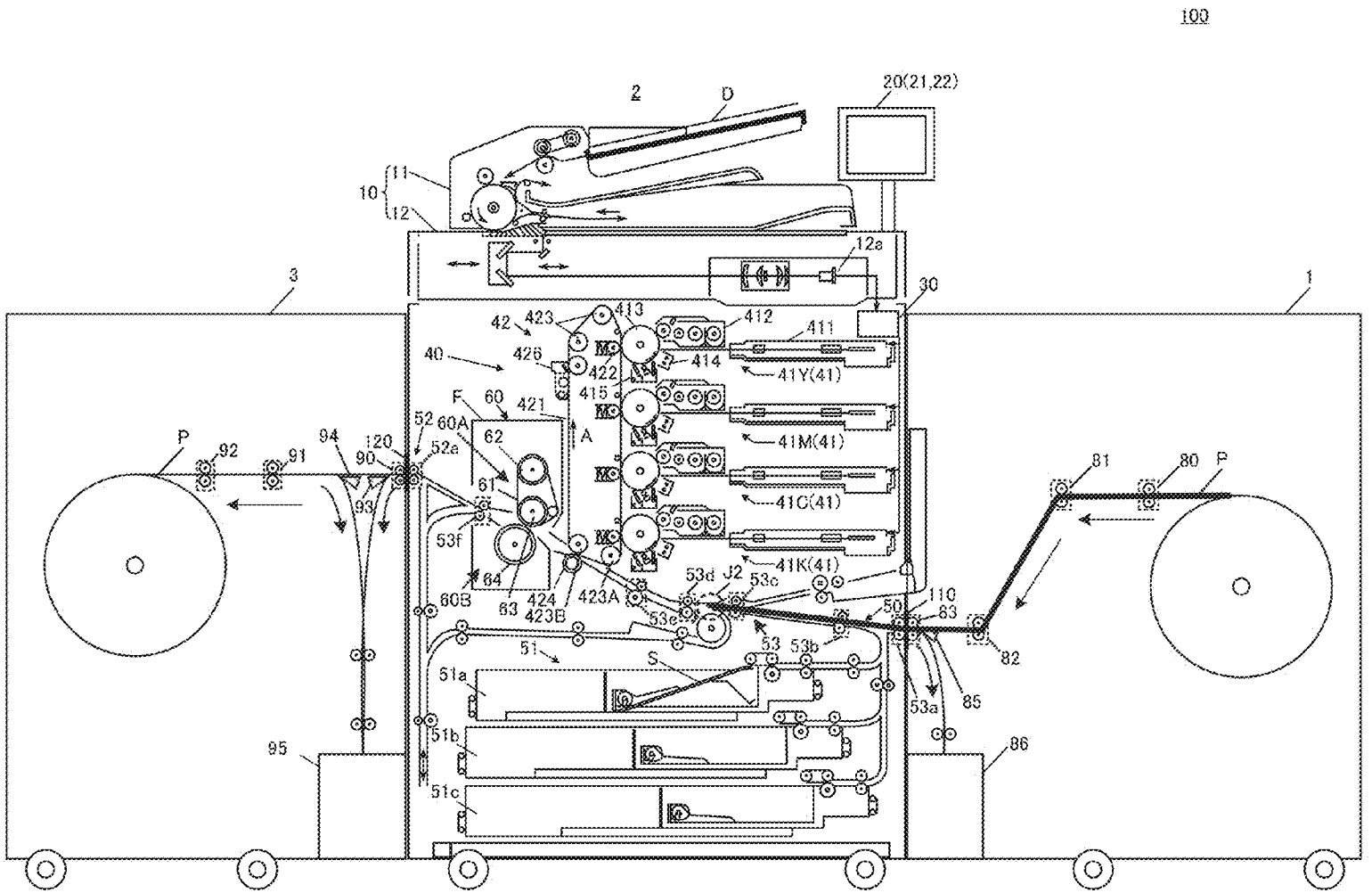
FIG. 4 illustrates a condition of a sheet jam in the present embodiment.

In addition, when a sheet jam is caused on the upstream side in the conveyance direction of an image formation position (secondary transfer nip) for forming an image on long sheet P (at position J2 on the sheet conveyance path in FIG. 4, for example) and at a leading end portion of long sheet P in image forming apparatus 2, control section 101 reversely rotates conveyance roller pairs 53*a* to 53*c*, and 80 to 83, to thereby convey long sheet P in the direction opposite to the conveyance direction until the leading end portion of long sheet P moves to the upstream side of conveyance roller pair 80 in the conveyance direction. Thereafter, the user opens the front door of sheet feeding apparatus 1 to reset long sheet P in sheet feeding apparatus 1. It is to be noted that control section 101 may cut long sheet P along the width direction by controlling sheet-feeding side cutting section 110. In this case, control section 101 reversely rotates conveyance roller pairs 80 to 83, to thereby convey a part of cut long sheet P which remains in sheet feeding apparatus 1 in a direction opposite to the conveyance direction until the leading end portion of the part moves to the upstream side of conveyance roller pair 80 in the conveyance direction. In addition, control section 101 rotates conveyance path switching member 85 in the clockwise direction by a predetermined angle from the normal position illustrated in FIG. 4 and reversely rotates conveyance roller pairs 53*a* to 53*c*, to thereby convey a part of cut long sheet P which remains in sheet feeding apparatus 2 in a direction opposite to the conveyance direction to sheet feeding side evacuation section 86. Thereafter, the user opens the front door of sheet feeding apparatus 1 to reset long sheet P in sheet feeding apparatus 1, and removes long sheet P moved to sheet feeding side evacuation section 86.

Figure 5:
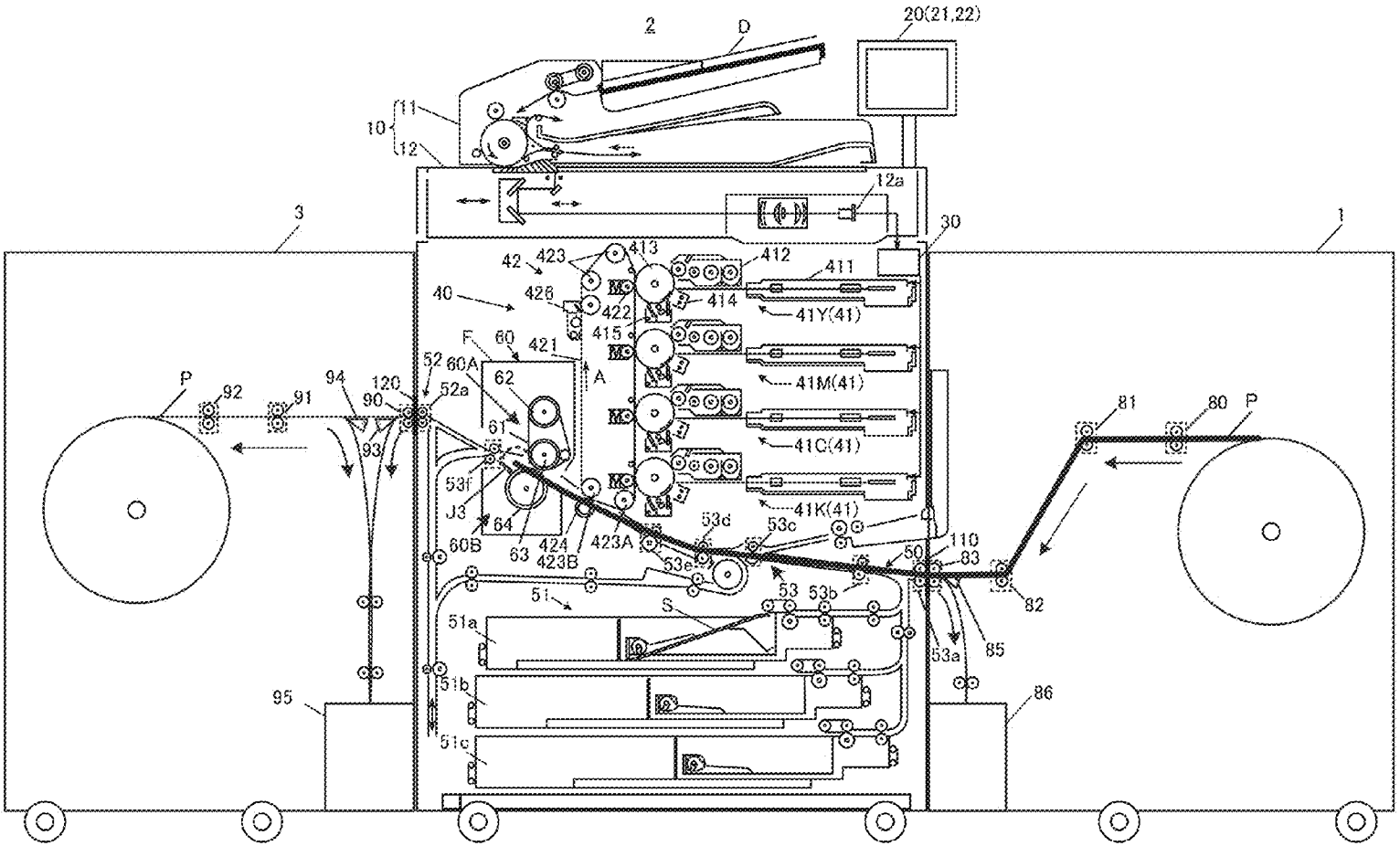
FIG. 5 illustrates a condition of a sheet jam in the present embodiment.

In addition, when a sheet jam is caused on the downstream side in the conveyance direction of a fixing position (fixing nip) for fixing an image on long sheet P (at position J3 on the sheet conveyance path in FIG. 5, for example) and at a leading end portion of long sheet P in image forming apparatus 2, control section 101 controls sheet-feeding side cutting section 110 to cut long sheet P along the width direction. Then, control section 101 reversely rotates conveyance roller pairs 80 to 83, to thereby convey a part of cut long sheet P which remains in sheet feeding apparatus 1 in a direction opposite to the conveyance direction until the leading end portion of the part moves to the upstream side of conveyance roller pair 80 in the conveyance direction. In addition, control section 101 rotates conveyance path switching member 93 in the counterclockwise direction by a predetermined angle from the normal position illustrated in FIG. 5 and rotates conveyance roller pairs 52*a*, 53*a* to 53*f*, and 90, fixing roller 63, pressure roller 64 and secondary transfer roller 424 forward, to thereby convey a part of cut long sheet P which remains in sheet feeding apparatus 2 in the conveyance direction to winding-side evacuation section 95. At this time, an unfixed toner on long sheet P which is moved to winding-side evacuation section 95 is fixed on long sheet P by image fixing section 60. In this manner, in comparison with the case where the part remaining in image forming apparatus 2 is conveyed in a direction opposite to the conveyance direction, it is possible to prevent the interior of image forming apparatus 2 (for example, the surfaces of conveyance roller pairs 53*a* to 53*e*) from being contaminated by unfixed toner images formed on the part. Thereafter, the user opens the front door of sheet feeding apparatus 1 to reset long sheet P in sheet feeding apparatus 1, and opens the front door of winding apparatus 3 to remove long sheet P which has moved to winding-side evacuation section 95.

Figure 8C:
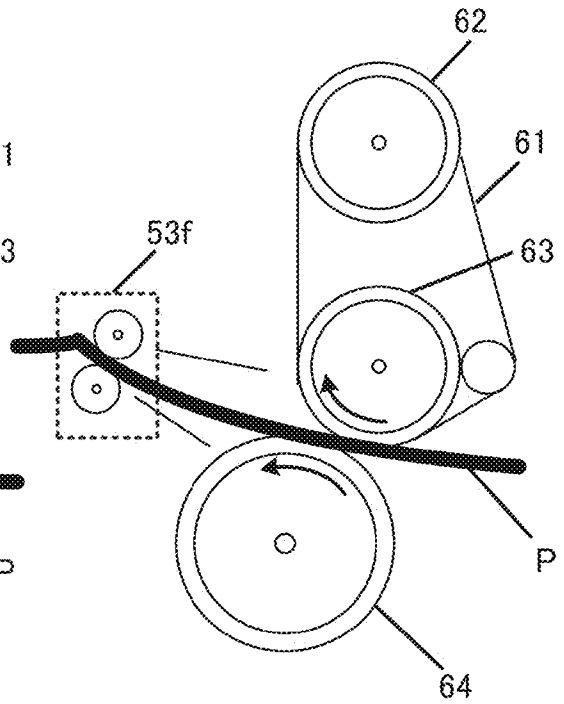
FIGS. 8A to 8C are explanatory views of an operation for eliminating an accordion jam in the present embodiment.
Figure 8B:
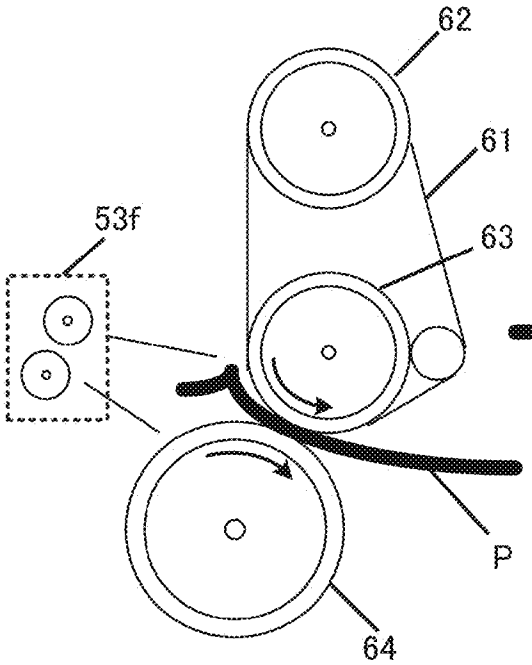
Figure 8A:
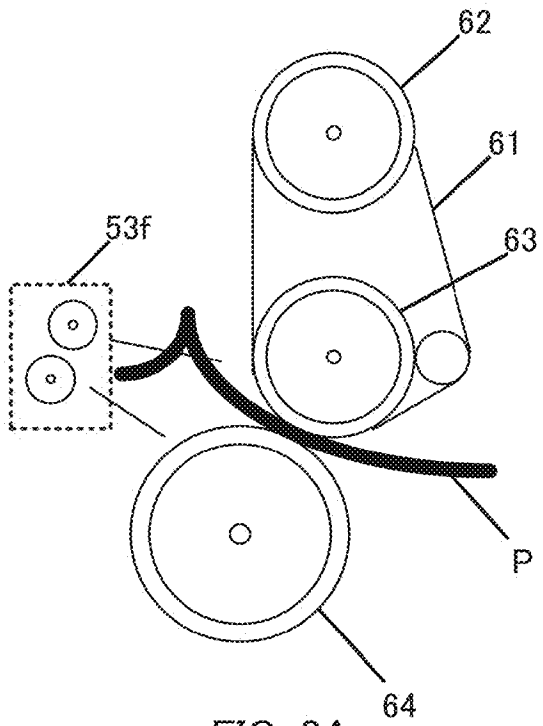

It is to be noted that the speed for conveying the part of cut long sheet P remaining in image forming apparatus 2 in the conveyance direction is a speed which is lower than the conveyance speed used for the case where no sheet jam is caused (for example, 315 [mm/sec]), and at which a fixation process can be performed (for example, 40 [mm/sec]). Preferably, when the sheet jam is an accordion jam, control section 101 conveys the part of cut long sheet P remaining in image forming apparatus 2 in the conveyance direction after performing an operation for eliminating the accordion jam as illustrated in FIGS. 8A to 8C. FIG. 8A illustrates a state where an accordion jam is caused on the downstream side of the fixing nip in the conveyance direction and at a leading end portion of long sheet P. In this case, as illustrated in FIG. 8B, control section 101 reversely rotates fixing roller 63 and pressure roller 64 which are disposed immediately before the position where the sheet jam has been caused on the upstream side in the conveyance direction, to thereby convey long sheet P through the fixing nip to return the accordion jam. Thereafter, as illustrated in FIG. 8C, control section 101 rotates fixing roller 63 and pressure roller 64 forward for a predetermined period at a time when the accordion jam is returned (which is determined from the reverse rotation time of fixing roller 63 and pressure roller 64), to thereby prepare for conveying the part remaining in image forming apparatus 2 in the conveyance direction.

Figure 6:
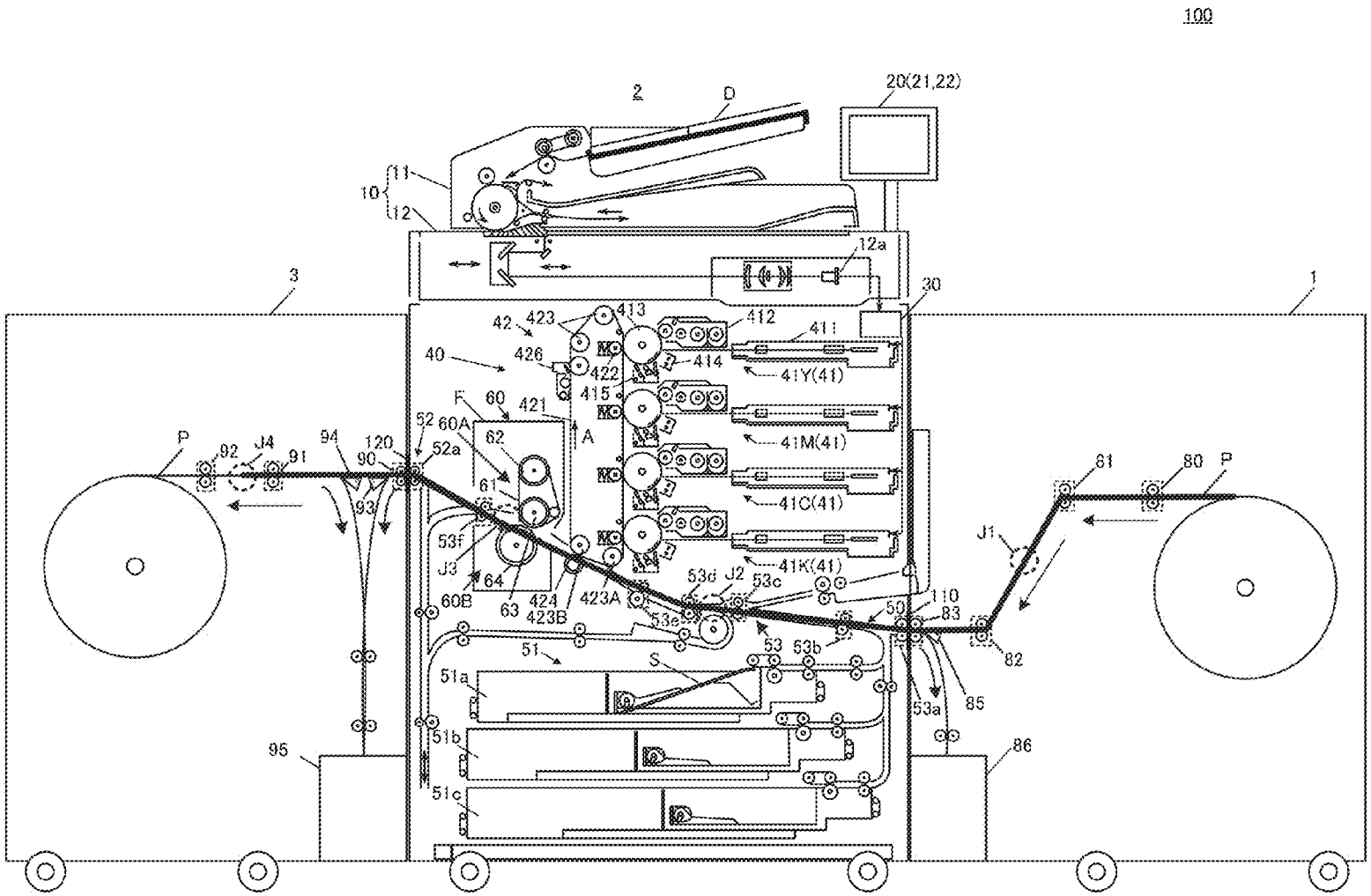
FIG. 6 illustrates a condition of a sheet jam in the present embodiment.

In addition, when a sheet jam (for example, accordion jam) is caused at a leading end portion of long sheet P in winding apparatus 3 (at position J4 on the sheet conveyance path in FIG. 6, for example), control section 101 reversely rotates conveyance roller pair 91 disposed immediately before the position where the sheet jam has been caused on the upstream side in the conveyance direction, to thereby convey long sheet P through conveyance roller pair 91 to return the accordion jam. Thereafter, control section 101 rotates conveyance roller pair 91 forward for a predetermined period at a time when the accordion jam is returned, to thereby prepare for conveying long sheet P in the conveyance direction. It is to be noted that control section 101 may control winding-side cutting section 120 to cut long sheet P along the width direction. In this case, control section 101 rotates conveyance roller pairs 90 to 92 forward, to thereby convey a part of cut long sheet P which remains in winding apparatus 3 in the conveyance direction to the downstream side in the conveyance direction of conveyance path switching member 94. Thereafter, control section 101 rotates conveyance path switching member 94 in the clockwise direction by a predetermined angle from the normal position illustrated in FIG. 6 and reversely rotates conveyance roller pairs 91 and 92, to thereby convey the part of cut long sheet P which remains in winding apparatus 3 in a direction opposite to the conveyance direction to winding-side evacuation section 95. Thereafter, the user opens the front door of winding apparatus 3 to remove long sheet P moved to winding-side evacuation section 95. Alternatively, a configuration may also be applicable in which the part of cut long sheet P which remains in winding apparatus 3 is not moved and the user opens the front door of winding apparatus 3 to remove the part remaining in the sheet conveyance path.

Figure 7:
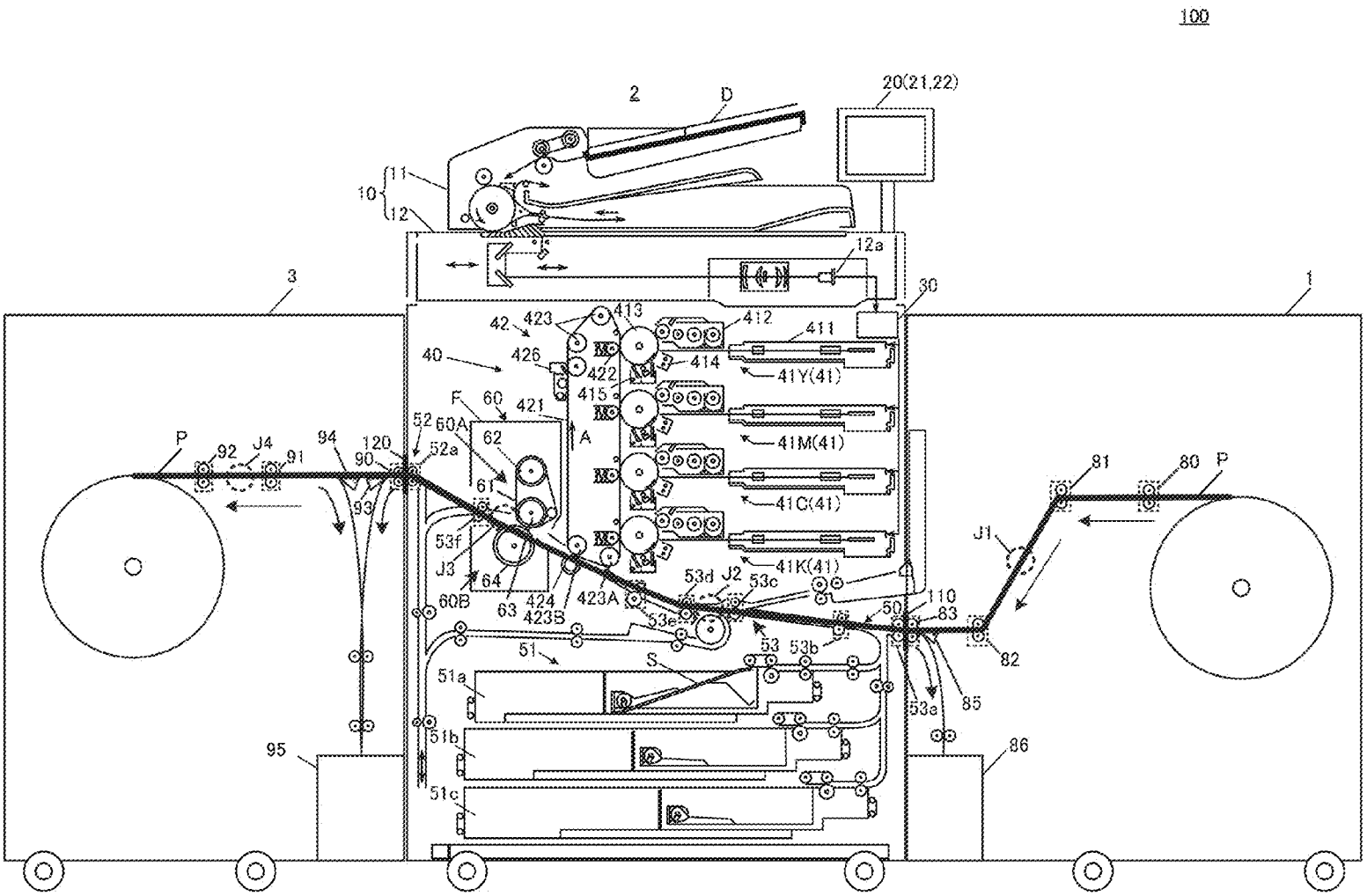
FIG. 7 illustrates a condition of a sheet jam in the present embodiment.

In addition, when a sheet jam (for example, an accordion jam) is caused at a middle portion of long sheet P in sheet feeding apparatus 1 (at position J1 on the sheet conveyance path in FIG. 7, for example), control section 101 reversely rotates conveyance roller pair 81 disposed immediately before the position where the sheet jam has been caused on the upstream side in the conveyance direction, to thereby convey long sheet P through conveyance roller pair 81 to return the accordion jam. Thereafter, control section 101 rotates conveyance roller pair 81 forward for a predetermined period at a time when the accordion jam is returned, to thereby prepare for conveying long sheet P in the conveyance direction. It is to be noted that, since control section 101 reversely rotates conveyance roller pair 81 to thereby absorb a slack of long sheet P, it is possible to separate conveyance roller pair 80 disposed on the upstream side of conveyance roller pair 81 in the conveyance direction. It should be noted that, when the sheet conveyance path is enough to absorb the slack, conveyance roller pair 80 may not be separated.

In addition, when a sheet jam (for example, accordion jam) is caused on the upstream side in the conveyance direction of an image formation position (secondary transfer nip) for forming an image on long sheet P (at position J2 on the sheet conveyance path in FIG. 7, for example) and at a middle portion of long sheet P (for example, accordion jam) in image forming apparatus 2, control section 101 reversely rotates conveyance roller pair 53*c* disposed immediately before the position where the sheet jam has been caused on the upstream side in the conveyance direction, to thereby convey long sheet P through conveyance roller pair 53*c* to return the accordion jam. Thereafter, control section 101 rotates conveyance roller pair 53*c* forward for a predetermined period at a time when the accordion jam is returned, to thereby prepare for conveying long sheet P in the conveyance direction. It is to be noted that, since control section 101 reversely rotates conveyance roller pair 53*c* to thereby absorb a slack of long sheet P, it is possible to separate conveyance roller pair 53*b* disposed on the upstream side of conveyance roller pair 53*c* in the conveyance direction. It should be noted that, when the sheet conveyance path is enough to absorb the slack, conveyance roller pair 53*b* may not be separated. It is to be noted that, when a sheet jam due to lateral deviation of long sheet P is caused, control section 101 controls guide plates (not illustrated) disposed on the both sides of long sheet P in the width direction to thereby cancel the deviation of long sheet P.

In addition, when a sheet jam (for example, accordion jam) is caused on the downstream side in the conveyance direction of a fixing position (fixing nip) for fixing an image on long sheet P (at position J3 on the sheet conveyance path in FIG. 7, for example) and at a middle portion of long sheet P in image forming apparatus 2, control section 101 reversely rotates fixing roller 63 and pressure roller 64 which are disposed immediately before the position where the sheet jam has been caused on the upstream side in the conveyance direction, to thereby convey long sheet P through the fixing nip to return the accordion jam. Thereafter, control section 101 rotates fixing roller 63 and pressure roller 64 forward for a predetermined period at a time when the accordion jam is returned, to thereby prepare for conveying long sheet P in the conveyance direction.

In addition, when a sheet jam (for example, accordion jam) is caused at a middle portion of long sheet P in winding apparatus 3 (at position J4 on the sheet conveyance path in FIG. 7, for example), control section 101 reversely rotates conveyance roller pair 91 disposed immediately before the position where the sheet jam has been caused on the upstream side in the conveyance direction, to thereby convey long sheet P through conveyance roller pair 91 to return the accordion jam. Thereafter, control section 101 rotates conveyance roller pair 91 forward for a predetermined period at a time when the accordion jam is returned, to thereby prepare for conveying long sheet P in the conveyance direction. It is to be noted that, since control section 101 reversely rotates conveyance roller pair 91 to absorb a slack of long sheet P, it is possible to separate conveyance roller pair 90 disposed on the upstream side of conveyance roller pair 91 in the conveyance direction. It should be noted that, when the sheet conveyance path is enough to absorb the slack, conveyance roller pair 90 may not be separated.

It is to be noted that conveyance roller pairs 52*a*, 53*a* to 53*f*, 80 to 83, and 90 to 92, fixing roller 63, pressure roller 64, conveyance path switching members 85, 93, and 94, sheet-feeding side cutting section 110, winding-side cutting section 120 and secondary transfer roller 424 correspond to the "unjamming execution section" of the embodiment of the present invention.

Figure 9:
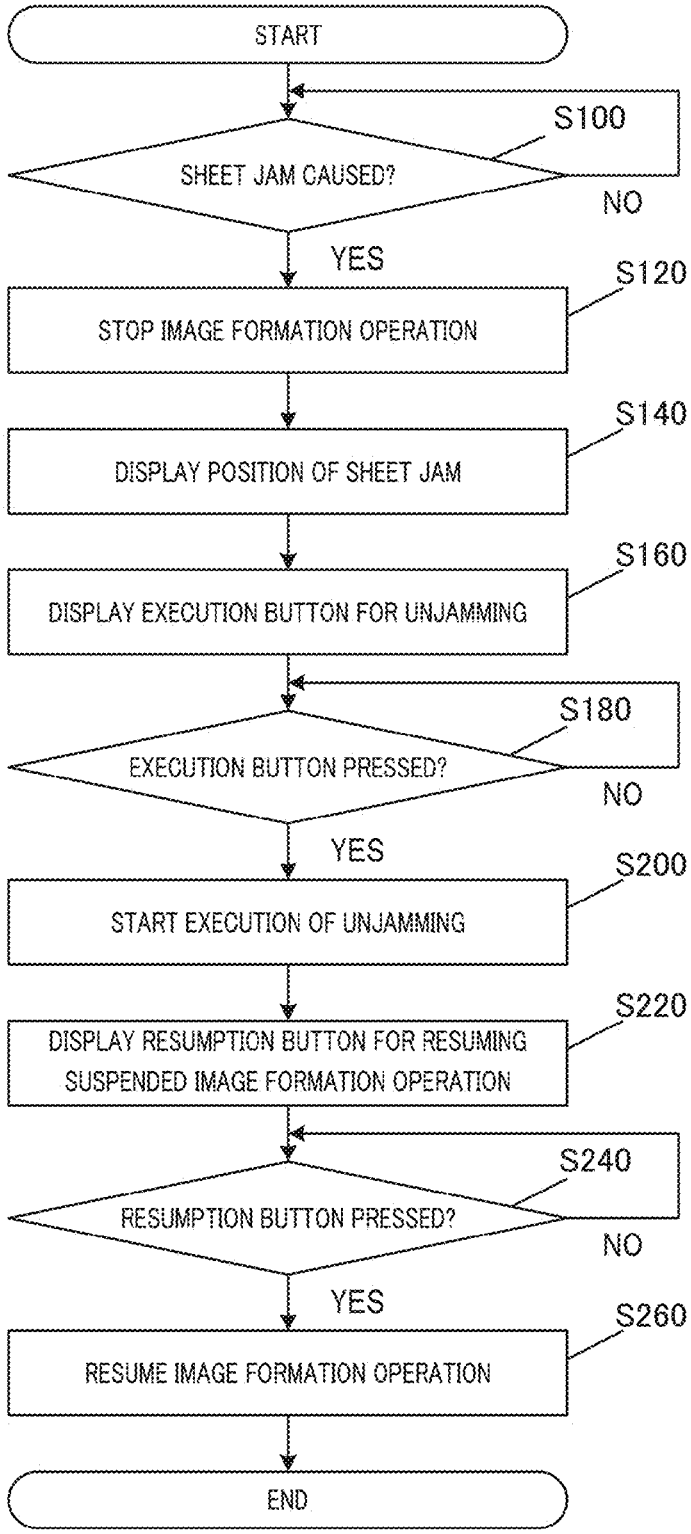
FIG. 9 is a flowchart of unjamming of the image forming system of the present embodiment.

Next, referring to the flowchart of FIG. 9, unjamming in image forming system 100 of the present embodiment is described. It is to be noted that the unjamming illustrated in FIG. 9 is executed at a time when an image formation process corresponding to a printing job is executed for example.

First, control section 101 determines whether a sheet jam has caused by confirming whether a jam code has been output from jam detection section 75 (step S100). When it is determined that no sheet jam has been caused (step S100, NO), the process is returned from step S100. On the other hand, when a sheet jam has been caused (step S100, YES), control section 101 controls image forming section 40 and fixing section 60 to stop the image formation operation on long sheet P (step S120).

Next, control section 101 refers to a jam code output from jam detection section 75, and controls display section 21 to display the position of the sheet jam (step S140). Next, control section 101 controls display section 21 to display an execution button for executing unjamming (step S160). It is to be noted that the execution button and a print button may be used in common.

Next, control section 101 determines whether the execution button displayed on display section 21 has been pressed by the user (step S180). When it is determined that the execution button has not been pressed by the user (step S180, NO), the process is returned from step S180. On the other hand, when the execution button has been pressed by the user (step S180, YES), control section 101 executes unjamming for eliminating the sheet jam in accordance with the condition of the sheet jam (step S200).

Next, control section 101 controls display section 21 to display a resumption button for resuming the suspended image formation operation (step S220). Next, control section 101 determines whether the resumption button displayed on display section 21 has been pressed by the user (step S240). When it is determined that the execution button has not been pressed by the user (step S240, NO), the process is returned from step S240. On the other hand, when the execution button has been pressed by the user (step S240, YES), control section 101 controls image forming section 40 and fixing section 60 to resume the image formation operation on long sheet P (step S260). Upon completion of the process of step S260, image forming system 100 terminates the process of FIG. 9.

It is to be noted that, when long sheet P is cut along the width direction in the unjamming in step S200, control section 101 may control display section 21 to display the cutting position. In addition, when unjamming is executed, the present position of long sheet P to be subjected to unjamming may be displayed on display section 21 in real time. With such a configuration, the user can easily understand the detail of the unjamming that is being performed in image forming system 100.

In addition, in the unjamming of step S200, when the part of long sheet P which is cut by sheet-feeding side cutting section 110 and which remains in image forming apparatus 2 is conveyed in the conveyance direction to winding-side evacuation section 95, it is desirable to preliminary run fixing section 60 so as to surely fix unfixed toner on the part image at a fixing temperature.

As has been described in detail, in the present embodiment, image forming system 100 includes sheet feeding apparatus 1 configured to feed long sheet P, image forming apparatus 2 configured to form an image on long sheet P fed from sheet feeding apparatus 1, and winding apparatus 3 configured to eject long sheet P on which an image is formed by image forming apparatus 2. Further, image forming system 100 includes an unjamming execution section configured to execute unjamming for eliminating a sheet jam when a sheet jam is caused in image forming system 100, and control section 101 configured to control the unjamming execution section to execute the unjamming in accordance with a position of the sheet jam or a portion of long sheet P causing the sheet jam, or both in the image forming system.

According to the above-mentioned configuration of the present embodiment, suitable unjamming is automatically executed in accordance with the condition of a sheet jam when a sheet jam is caused in image forming system 100, and thus the user can resume the image formation operation without doing very troublesome tasks of removing the long sheet causing the sheet jam which has been stopped in the middle of the conveyance (that is, a large burden is not imposed on the user).

While, in the above-mentioned embodiment, unjamming is executed when a request to execute unjamming is received at operation section 22 in the case where a sheet jam is caused in image forming system 100, unjamming may be executed irrespective of whether a request to execute unjamming is received at operation section 22. In addition, control section 101 may execute unjamming only while operation section 22 is receiving a request to execute unjamming (while the execution button is being pressed).

In the above-mentioned embodiment, it is desirable to stop the conveyance operation of long sheet P when a load greater than a prescribed torque is exerted on the driving motor of the conveyance roller pair performing the conveyance while long sheet P is being conveyed for unjamming at a speed (for example, 40 [mm/sec]) lower than the conveyance speed used for the case where no sheet jam is caused since, in such a case, it is highly possible that another sheet jam is caused during the conveyance of long sheet P and machine failure occurs if the conveyance operation is continued. In this case, unjamming is not performed in image forming system 100 but the user performs an appropriate unjamming.

While, in the above-mentioned embodiment, when long sheet P is cut along the width direction for unjamming, sheet-feeding side cutting section 110 or winding-side cutting section 120 under the control of control section 101 automatically cut long sheet P when a request to execute unjamming is received at operation section 22, the present invention is not limited to this. For example, the user may manually cut long sheet P. In addition, sheet-feeding side cutting section 110 or winding-side cutting section 120 under the control of control section 101 may automatically cut long sheet P before a request to execute unjamming is received at operation section 22.

In the above-mentioned embodiment, when a sheet jam is caused at a middle portion of long sheet P, the conveyance roller disposed immediately before the position where the sheet jam has been caused on the upstream side in the conveyance direction is rotated forward for unjamming after the conveyance roller is reversely rotated, the present invention is not limited to this. For example, as described for the case where a sheet jam is caused at the leading end portion of long sheet P, the unjamming may include a process for cutting long sheet P.

It should be understood by those skilled in the art that various modifications, combinations, sub-combinations and alterations may occur depending on design requirements and other factors in so far as they are within the scope of the appended claims or the equivalents thereof. While the invention made by the present inventor has been specifically described based on the preferred embodiments, it is not intended to limit the present invention to the above-mentioned preferred embodiments but the present invention may be further modified within the scope and spirit of the invention defined by the appended claims.

The invention claimed is:

1. An image forming system comprising:

a sheet feeding apparatus configured to feed a continuous sheet;

an image forming apparatus configured to form an image on the continuous sheet fed by the sheet feeding apparatus;

a sheet ejection apparatus configured to eject the continuous sheet on which the image is formed by the image forming apparatus;

a detection section comprising a plurality of sensors configured to detect a position of a sheet jam or a portion of the continuous sheet causing the sheet jam, or both, in the image forming system;

an unjamming execution section configured to execute unjamming for eliminating a sheet jam when the sheet jam is caused in the image forming system; and a control section configured to control the unjamming execution section to execute the unjamming in accordance with a position of the sheet jam or a portion of the continuous sheet causing the sheet jam, or both, detected by the detection section, wherein the unjamming execution section includes a cutting section disposed between the sheet feeding apparatus and the image forming apparatus and configured to cut the continuous sheet along a width direction.

2. The image forming system according to claim 1 further comprising an operation reception section configured to receive a request to execute the unjamming, wherein the control section executes the unjamming when a request to execute the unjamming is received at the operation reception section.

3. The image forming system according to claim 1, wherein, when the sheet jam is caused in the sheet feeding apparatus at a leading end portion of the continuous sheet, the unjamming includes a process in which the continuous sheet is conveyed in a direction opposite to a conveyance direction.

4. The image forming system according to claim 1, wherein, when the sheet jam is caused in the image forming apparatus at a leading end portion of the continuous sheet on an upstream side in a conveyance direction of an image formation position for forming an image on the continuous sheet, the unjamming includes a process in which the continuous sheet is conveyed in a direction opposite to the conveyance direction.

5. The image forming system according to claim 1 further comprising an evacuation section configured to evacuate the continuous sheet from a sheet conveyance path, wherein when the sheet jam is caused in the image forming apparatus at a leading end portion of the continuous sheet on an upstream side in a conveyance direction of an image formation position for forming an image on the continuous sheet, the unjamming includes a process in which a part of the continuous sheet that is cut by the cutting section and that remains in the sheet feeding apparatus is conveyed in a direction opposite to the conveyance direction whereas another part of the continuous sheet that is cut by the cutting section and that remains in the image forming apparatus is conveyed in the direction opposite to the conveyance direction to the evacuation section.

6. The image forming system according to claim 1 further comprising an evacuation section configured to evacuate the continuous sheet from a sheet conveyance path, wherein the image forming apparatus fixes the image formed on the continuous sheet to the continuous sheet, and, when the sheet jam is caused in the image forming apparatus at a leading end portion of the continuous sheet on a downstream side in a conveyance direction of a fixing position for fixing the image on the continuous sheet, the unjamming includes a process in which a part of the continuous sheet that is cut by the cutting section and that remains in the sheet feeding apparatus is conveyed in a direction opposite to the conveyance direction whereas another part of the continuous sheet that is cut by the cutting section and that remains in the image forming apparatus is conveyed in the conveyance direction to the evacuation section.

7. The image forming system according to claim 6, wherein a speed for conveying the part remaining in the image forming apparatus is a speed at which a fixation process is allowed to be performed and which is lower than a conveyance speed used for a case where the sheet jam is not caused.

8. The image forming system according to claim 1, wherein, when the sheet jam is caused in the sheet ejection apparatus at a leading end portion of the continuous sheet, the unjamming includes a process in which a conveyance roller disposed immediately before a position where the sheet jam is caused on an upstream side in the conveyance direction is reversely rotated before the conveyance roller is rotated forward.

9. The image forming system according to claim 1, wherein, when the sheet jam is caused at a middle portion of the continuous sheet, the unjamming includes a process in which a conveyance roller disposed immediately before a position where the sheet jam is caused on an upstream side in the conveyance direction is reversely rotated before the conveyance roller is rotated forward.

10. The image forming system according to claim 1 further comprising an operation reception section configured to receive a request to execute the unjamming, wherein the control section executes the unjamming when a request to execute the unjamming is received at the operation reception section.

11. The image forming system according to claim 1, wherein, when the sheet jam is caused in the sheet feeding apparatus at a leading end portion of the continuous sheet, the unjamming includes a process in which the continuous sheet is conveyed in a direction opposite to a conveyance direction.

12. The image forming system according to claim 1, wherein, when the sheet jam is caused in the sheet ejection apparatus at a leading end portion of the continuous sheet, the unjamming includes a process in which a conveyance roller disposed immediately before a position where the sheet jam is caused on an upstream side in the conveyance direction is reversely rotated before the conveyance roller is rotated forward.

13. The image forming system according to claim 1, wherein, when the sheet jam is caused at a middle portion of the continuous sheet, the unjamming includes a process in which a conveyance roller disposed immediately before a position where the sheet jam is caused on an upstream side in the conveyance direction is reversely rotated before the conveyance roller is rotated forward.

14. An image forming system comprising:

a sheet feeding apparatus configured to feed a continuous sheet;

an image forming apparatus configured to form an image on the continuous sheet fed by the sheet feeding apparatus;

a sheet ejection apparatus configured to eject the continuous sheet on which an image is formed by the image forming apparatus;

a detection section comprising a plurality of sensors configured to detect a position of a sheet jam or a portion of the continuous sheet causing the sheet jam, or both, in the image forming system;

an unjamming execution section configured to execute unjamming for eliminating a sheet jam when the sheet jam is caused in the image forming system; and a control section configured to control the unjamming execution section to execute the unjamming in accordance with a position of the sheet jam or a portion of the continuous sheet causing the sheet jam, or both, detected by the detection section, wherein the unjamming execution section includes a cutting section disposed between the image forming apparatus and the sheet ejection apparatus and configured to cut the continuous sheet along a width direction.

15. The image forming system according to claim 14, wherein, when the sheet jam is caused in the image forming apparatus at a leading end portion of the continuous sheet on an upstream side in a conveyance direction of an image formation position for forming an image on the continuous sheet, the unjamming includes a process in which the continuous sheet is conveyed in a direction opposite to the conveyance direction.

16. The image forming system according to claim 14, further comprising an evacuation section configured to evacuate the continuous sheet from a sheet conveyance path, wherein when the sheet jam is caused in the sheet ejection apparatus at a leading end portion of the continuous sheet, the unjamming includes a process in which a part of the continuous sheet that is cut by the cutting section and that remains in the sheet ejection apparatus is conveyed in a direction opposite to a conveyance direction to the evacuation section.

* * * * *